US005873986A

United States Patent [19]

Thompson, III et al.

[11] Patent Number: 5,873,986

[45] Date of Patent: Feb. 23, 1999

[54] METAL RECOVERY APPARATUS

[75] Inventors: Ernest E. Thompson, III, Avon; David L. Fenton, Mt. Morris; Charles E. Welch, Wyoming, all of N.Y.

[73] Assignee: CPAC, Inc., Leicester, N.Y.

[21] Appl. No.: 816,789

[22] Filed: Mar. 19, 1997

[51] Int. Cl.[6] ..... C25B 15/00

[52] U.S. Cl. ..... 204/237; 204/272; 204/273

[58] Field of Search ..... 204/237, 272, 204/273

[56] References Cited

U.S. PATENT DOCUMENTS

| | | | |
|---|---|---|---|
| 3,003,942 | 10/1961 | Cedrone | 204/272 |
| 3,702,814 | 11/1972 | Mandroian | 204/237 |
| 3,728,235 | 4/1973 | Cooley et al. | 204/109 |
| 3,751,351 | 8/1973 | Zankowski | 204/109 |
| 4,028,212 | 6/1977 | Bowen et al. | 204/109 |
| 4,049,512 | 9/1977 | Tolle, Jr. | 204/212 |
| 4,149,954 | 4/1979 | Ransbottom | 204/272 |
| 5,486,272 | 1/1996 | Hemsley et al. | 204/272 |
| 5,656,140 | 8/1997 | Desterle et al. | 204/272 |

*Primary Examiner*—Bruce F. Bell
*Attorney, Agent, or Firm*—Eugene Stephens & Associates

[57] ABSTRACT

A metal recovery apparatus in which metal-laden fluid is cycled through an electrolytic cell at a relatively low flow rate, but fluid within the cell is forced to swirl at a relatively high speed to improve electroplating of metal on an electrode. Two fluid circuits are used to achieve the high speed within the cell: a fluid supply circuit runs fluid through the apparatus at a relatively low flow rate (about 2 to about 4 gallons per minute); a fluid circulation circuit boosts the speed of the fluid within the cell and forces it to swirl by discharging fluid drawn from the cell back into the cell at a relatively high flow rate (about 20 to about 40 gallons per minute). The apparatus includes inner and outer electrodes defining an annular space in which the fluid circulates. The outer electrode is preferably removable from the apparatus and is preferably the cathode. A seam in the cathode allows the cathode to be opened for removal of metal plated on the cathode. Current efficiency within the circulating fluid is optimized by using a cathode-to-anode surface area ratio of between about 1.8:1 and about 2.4:1, further enhancing recovery of metal from the fluid. The apparatus is particularly suited for the recovery of silver from photographic chemicals, especially bleach-fix solutions.

46 Claims, 3 Drawing Sheets

METAL RECOVERY APPARATUS

TECHNICAL FIELD

The invention relates to the recovery of electrically-conductive metals from solution. The invention is especially suited for the recovery of silver from photographic chemicals, particularly bleach-fix.

BACKGROUND OF THE INVENTION

In many commercial and chemical processes, such as photographic film processing, metals are dissolved in fluids. The metal-laden fluids are often simply thrown away, wasting valuable metals and polluting the environment. As a result, methods and apparatus have been developed to recover these metals from the fluids in which they are dissolved.

A typical recovery apparatus includes an electrolytic cell through which metal-laden fluid is cycled. The cell typically includes two electrodes between which the fluid passes, one or more of the electrodes being rotated to provide agitation of the fluid. The fluid is stored in a batch tank and is sent through the cell by a fluid supply circuit. As fluid passes through the cell, metal plates onto one of the electrodes by virtue of an electrolytic reaction. In the case of silver, it plates onto the cathode. The metal-laden fluid is circulated through the supply circuit until the electrolytic reaction reaches equilibrium, at which point the fluid is drained from the cell and the metal is removed from the electrode.

Prior art recovery devices typically have a low flow rate within the cell as a result of the use of a single fluid circuit (the supply circuit). The low flow rate results in limited exposure of the fluid to the electrode onto which the dissolved metal plates. A batch of fluid, therefore, takes a long time to reach equilibrium.

Prior art devices do not take full advantage of the relationship between the current efficiency in a cell and the rate at which metal plates onto the electrode. These devices have lower than optimum current efficiencies, reducing the amount of metal that can be drawn out of solution in a given amount of time. This also increases the amount of time a batch of fluid takes to reach equilibrium.

SUMMARY OF THE INVENTION

Our invention reduces batch time by introducing a swirl within the cell. This increases the speed of fluid within the cell without increasing the through-flow rate. We do this by including a second fluid circuit, a circulation circuit, attached to the cell. The circulation circuit has a much higher flow rate than the supply circuit, increasing exposure of the fluid to the electrodes, but allowing a low through-flow rate. In our preferred embodiment, we direct the flow within the cell so that the fluid is effectively agitated near the outer electrode of the cell. Increased turbulence and/or higher angular speed of the fluid near the outer electrode provide this effective agitation.

We also use a substantially optimal current efficiency in our recovery apparatus to reduce batch time. By sizing the cell with the surface area of one electrode (that on which the metal plates) about 1.8 to 2.4 times the surface area of the other electrode, we achieve a current efficiency that maximizes metal recovery. In the case of a silver recovery cell, the cathode has about 1.8 to 2.4 times the surface area of the anode.

We size our apparatus and use an annular channel in the cell to minimize the amount of fluid in the cell at a given time. This allows smaller pumps to be used to provide the necessary circulation without vortexing. Using smaller pumps also reduces the size, weight, and cost of our apparatus.

Because we use stationary electrodes, the basic structure of our device is simpler and less likely to leak than prior art devices. The use of a circulation circuit to provide agitation of the fluid results in a more reliable, faster recovery device.

DESCRIPTION OF THE INVENTION

Figure 2:
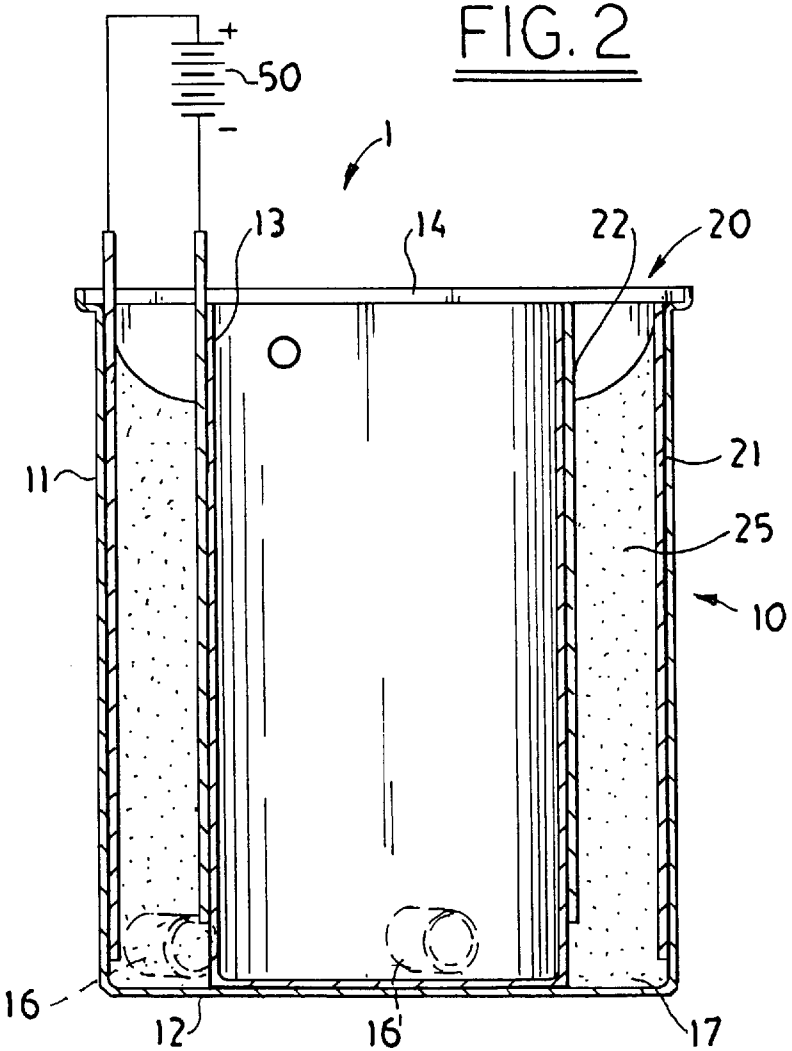
FIG. 2 is a cross section of the invention taken along the line 2—2 in FIG. 1.
Figure 1:
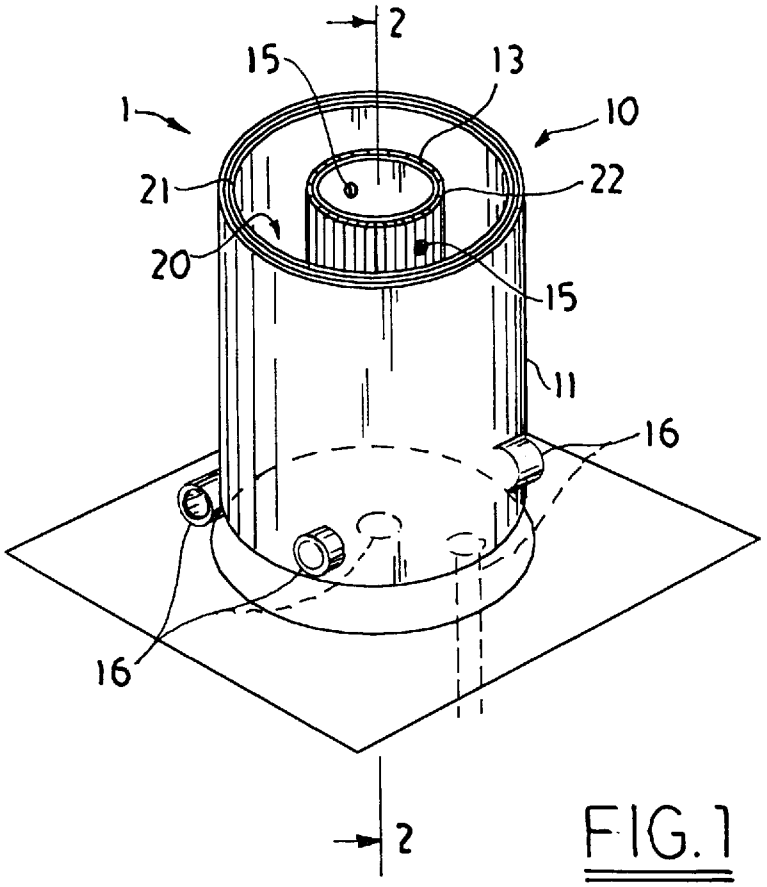
FIG. 1 is an isometric view of the invention.
Figure 4:
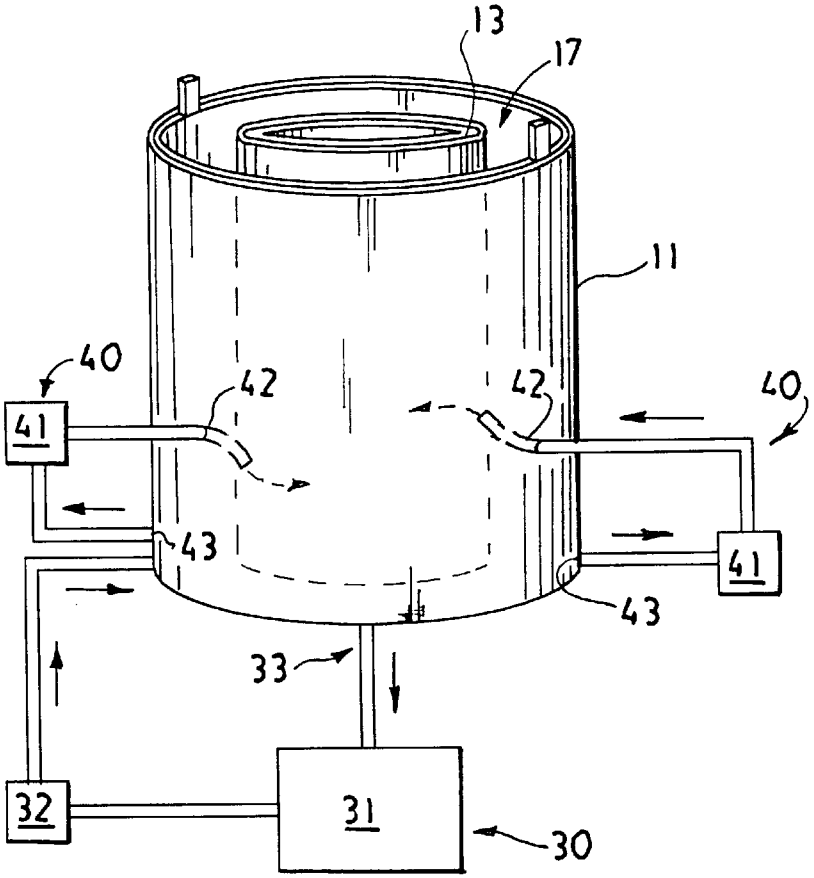
FIG. 4 is a schematic representation of the preferred embodiment of the invention.
Figure 3:
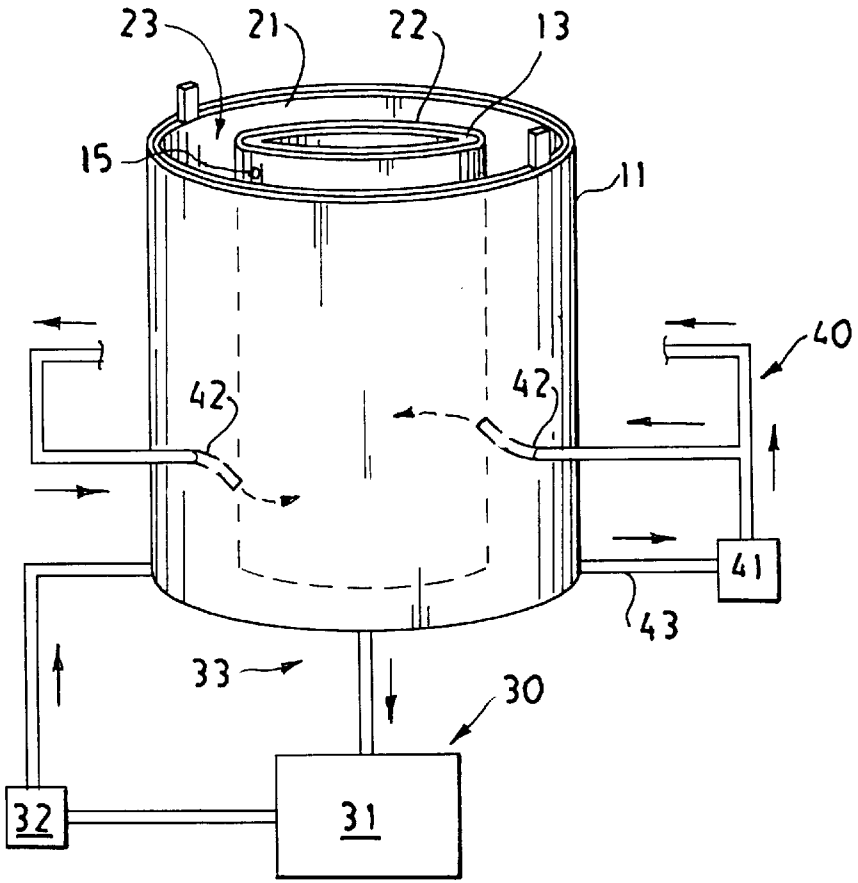
FIG. 3 is a schematic representation of the invention.
Figure 7:
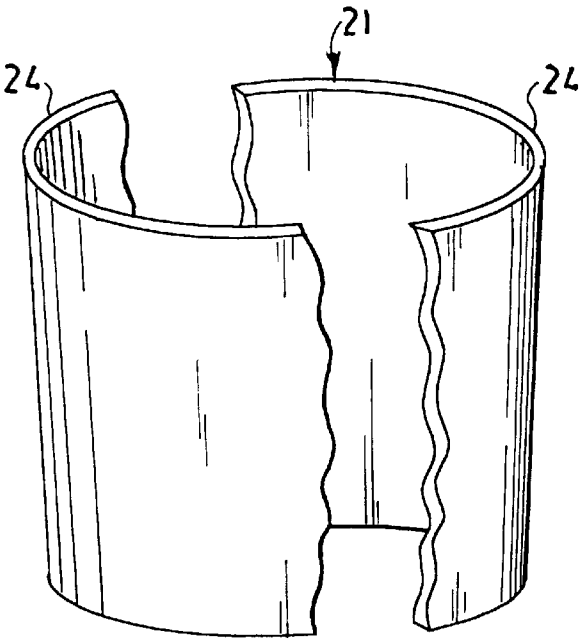
FIG. 7 is a view of the outer electrode shown in FIG. 6, but spilt according to the removal mode of the preferred embodiment of the invention.
Figure 6:
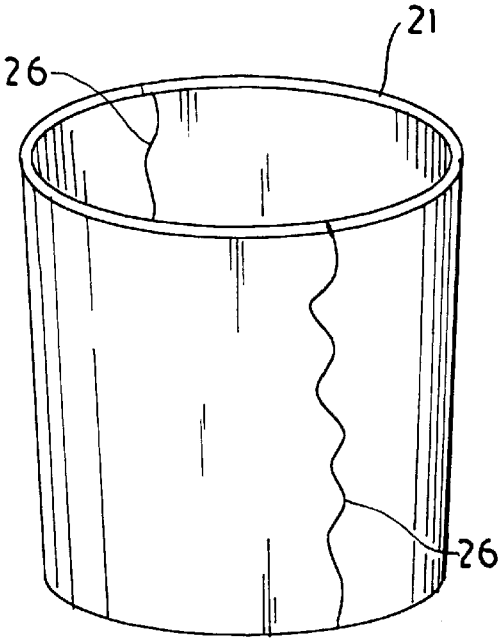
FIG. 6 is a view of the outer electrode according to the preferred embodiment of the invention.
Figure 5:
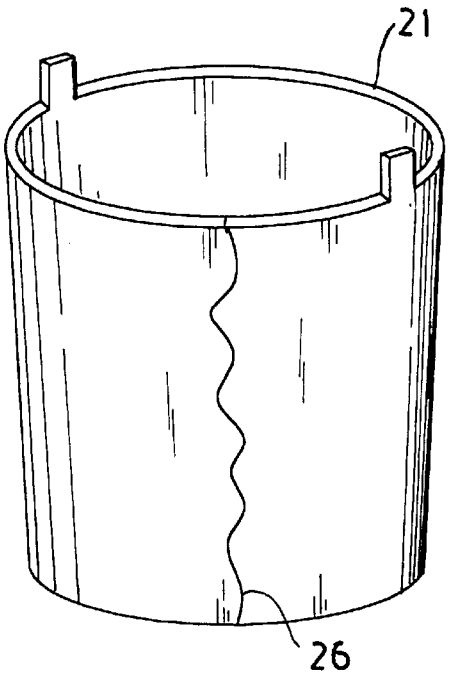
FIG. 5 is a view of the outer electrode of the invention.

With reference to the accompanying figures, the components of our apparatus 1 are disposed within a casing 10 made from a resinous material, such as plastic or fiberglass. The casing 10 is preferably formed with a substantially cylindrical outer portion 11, but will typically have a taper as a result of molding draw. We prefer to include a second cylinder 13 within the casing to form an annular cavity or channel 17 through which we circulate metal-laden fluid. A bottom 12 is sealed to the lower edges of the outer and inner cylinders 11, 13 of the casing 10. We also include a removable cover 14 that prevents spillage of metal-laden fluid during processing of a batch of fluid. Couplings 16 on the casing 10 can be used for connections of fluid circuits and passage of electrical equipment. We also provide an overflow path 33 so that fluid in the cell can return to a batch tank 31. Preferably, the overflow path 33 comprises holes 15 in an upper region of the inner cylinder 13. The casing 10 contains an electrolytic cell 20 that is designed to minimize the amount of liquid in the cell 20 at a given time. The annular channel 17 between the outer and inner cylinders 11, 13 makes it possible to use a minimum amount of fluid in the cell 20 while retaining the outer diameter necessary to achieve our desired fluid speed. This allows smaller pumps to be used to provide the necessary circulation and agitation without vortexing.

We form an electrolytic cell 20 within the casing 10 including an outer electrode 21 and an inner electrode 22 arranged in the annular channel 17. The electrodes can be made of carbon, metal, or any other conductive material. The electrodes can even be made of non-conductive material coated with a conductive material, which is a way to make inexpensive, disposable electrodes.

The outer electrode 21 we form as a removable sleeve that engages the inner surface of the casing's outer cylinder 11. For silver recovery, the outer electrode 21 is the cathode. The outer surface of the outer electrode 21 is coated with a non-conductive material to prevent plating of metal on the outer surface. The non-conductive coating also prevents the casing 10 from being electrically charged, which might cause metal to plate onto the casing rather than on the outer electrode 21. We also form the sleeve 21 with a seam 26 for improved removal of plated silver.

The inner electrode 22 is arranged near the outer surface of the casing's inner cylinder 13 and can take the form of a series of conductive plates attached to the same pole of an electrical source 50 or a single, cylindrical electrode. Whatever its form, the inner electrode 22 can be made of any conductive material or non-conductive material coated with a conductive material as mentioned above.

When a batch of fluid is to be processed, the electrodes 21, 22 are attached to respective poles of a DC source of electricity 50 to establish an electrical potential between the electrodes. When fluid is present, an electrical current runs through the fluid, inducing electroplating of metal onto one of the electrodes 21, 22.

The sizing and spacing of the electrodes 21, 22 are preferably such that the ratio of the area of the inner surface of the outer electrode to the area of the outer surface of the inner electrode falls in the range of from about 1.8:1 to about 2.4:1 for optimum current efficiency. We have found that current efficiency is maximized when this ratio is about 2:1. A spacing between the cells of from about 1.5 inches to about 2.5 inches is particularly suited for optimum current efficiency.

As in prior art cells, we include a fluid supply or through-flow circuit 30 that pumps metal-laden fluid through the cell from the batch tank 31 in which the fluid is stored. A pump 32 in the supply circuit 30 takes fluid from the batch tank 31 and sends it to the cell 20. Fluid from the cell returns to the batch tank via the overflow path 33, which includes holes 15. The supply circuit 30 preferably pumps fluid through the cell at a relatively low flow rate. For example, the flow rate in the supply circuit can be in the range of from about 2 gallons per minute to about 4 gallons per minute.

Unlike prior art cells, we also provide a second fluid circuit 40 for circulating fluid at high speed within the annular channel 17, particularly within the annulus 23 defined by the electrodes. A discharge 42 from the circulation circuit 40 is disposed within the electrode annulus 23 and annular channel 17 so that fluid in the electrode annulus 23 travels at a higher angular speed and with more turbulence near the outer boundary of the electrode annulus 23 (the inner surface of the outer electrode). This provides the agitation we require for improved plating and effectively creates an annulus of fluid 25 in the cell 20 that is coaxial with the electrodes 21, 22 and the inner and outer cylinders 11, 13 of the casing 10. The annulus of fluid 25 rotates about its central longitudinal axis with a higher angular velocity in the outer portion of the annulus 25 than it does in the inner portion of the annulus 25. We prefer to include two discharges 42 disposed 180° apart within the electrode annulus 23 and the annular channel 17, to maximize the swirling and to further boost the fluid speed within the fluid annulus 25. All intakes 43 and discharges 42 for the circulation circuit 40, as well as those of the supply circuit 30, are preferably disposed adjacent the bottom sides of the cell 20 to prevent vortexing.

Fluid is drawn into the circulation circuit 40 through the intake(s) 43 and is energized by a pump 41 to a relatively high flow rate. The fluid is then returned to the cell 20 through the discharges 42 of the circulation circuit 40 so that the speed of fluid within the cell 20 is far greater than it would be if only the supply circuit 30 were used. The discharge 42 is arranged so that it forces the fluid in the cell 20 to swirl within the annulus 23 and annular channel 17, inducing the rotation discussed above. Our preferred arrangement has a circulation circuit flow rate that is an order of magnitude greater than the through-flow rate provided by the supply circuit. We prefer to use a circulation circuit flow rate in the range of from about 20 gallons per minute to about 40 gallons per minute and a supply circuit flow rate in the range of from about 2 gallons per minute to about 4 gallons per minute. We also prefer to use two pumps 41, each drawing fluid from the cell 20 from a respective intake 43 and returning fluid to the cell through a respective discharge 42, the discharges 42 being diametrically opposed within the annulus 23 and the annulus of fluid 25. With the fluid speed and turbulence thus boosted in the cell 20, plating of metal from the fluid occurs more rapidly, efficiently, and with more uniform plating on the outer electrode, saving processing time for individual batches and increasing the number of batches that may be processed in a given amount of time. The increased metal plating results from increased exposure of the metal fluid to the electrode on which the metal plates. Additionally, interfering side reactions at the anode (inner electrode 22 in the preferred embodiment) are reduced as a result of the lower angular speed and reduced turbulence of the fluid near the inner electrode 22.

Because we prefer to make the outer electrode 21 the cathode for silver recovery, silver plates on the inner surface of the outer electrode 21 in the preferred embodiment. Easy removal of the outer electrode 21 is thus important for recovery of silver plated on the cathode at the end of a batch job. This is why we prefer to form the outer electrode 21 as a sleeve that can be inserted into and removed from the casing 10. The non-conductive coating on the outer surface of the outer electrode 21 also ensures easy removal since silver is prevented from bonding the outer electrode 21 to the casing 10. As mentioned above, we form the outer electrode with a seam 26 that allows easier removal of the silver plated onto the electrode 21. To remove the silver, we strike the electrode 21 with a mallet or the like, open the electrode 21, and continue striking the electrode 21 until all of the plated metal falls off. We prefer to use two seams 26 so that the electrode 21 can be split into two semicylinders 24, making removal of the silver even easier.

An effect of the increased fluid speed within the cell 20 is that the fluid level rises at the outer electrode 21 when the fluid is being processed. For example, the fluid can rise as much as one inch during a processing job. Consequently, we size the outer electrode 21 such that its upper edge will remain above the fluid level at all times during processing of the fluid. Keeping the upper edge of the outer electrode 21 above the surface also prevents metal from forming a ridge on the top of the electrode 21.

To prevent chemical and metal buildup in the apparatus between batches, we leave a small amount of fluid within the cell. In our preferred embodiment, we have found that leaving about an inch of fluid in the cell is adequate to prevent such buildup.

Parts List

1 Metal recovery apparatus

10 Casing

11 Outer cylinder of casing

12 Bottom of casing

13 Inner cylinder of casing

14 Cover

15 Holes for overflow in overflow path

16 Couplings for electrical equipment and fluid circuit connections

17 Annular cavity/channel between outer and inner cylinders of casing

20 Electrolytic cell
21 Outer electrode/Cathode
22 Inner electrode(s)/Anode(s)
23 Annulus defined by electrodes/Electrode annulus
24 Semicylinder/Half of outer electrode
25 Annulus of fluid/Fluid annulus
26 Seam in outer electrode
30 Fluid supply circuit
31 Batch/Supply tank
32 Supply circuit pump
33 Fluid return circuit/Overflow path
40 Fluid circulation circuit
41 Circulation circuit pump(s)
42 Circulation circuit discharge(s)
43 Circulation circuit intake(s)
50 DC source of electricity

We claim:

1. A metal recovery apparatus for the recovery of metal from metal-laden fluids comprising:

a first fluid circuit including a first circulation pump that circulates fluid within an annulus, the annulus comprising:

an inner surface of the annulus that is electrically charged with one polarity;

an outer surface of the annulus that is electrically charged with an opposite polarity; and the charges of the inner and outer surfaces inducing an electrical current through the fluid as it circulates in the annulus, the electrical current forcing metal dissolved in the fluid to plate onto one of the inner and outer surfaces of the annulus; and a second fluid circuit between the cell and a batch tank, the second fluid circuit including a supply pump for supplying metal-laden fluid to the cell from the batch tank and returning fluid from the cell to the batch tank, a flow rate in the second fluid circuit being substantially lower than a flow rate in the first fluid circuit, the higher flow rate in the first fluid circuit providing at least a minimum agitation flow rate that substantially reduces a boundary layer at the outer surface of the annulus.

2. The metal recovery apparatus of claim 1 wherein the inner surface is an anode and the outer surface is a cathode.

3. The metal recovery apparatus of claim 1 wherein the outer surface of the annulus is an inner surface of a cylindrical sleeve, the sleeve being slidable into a cylindrical shell and comprising a seam that allows the sleeve to be bent out of its cylindrical shape for removal of metal plated onto the inner surface of the sleeve.

4. The metal recovery apparatus of claim 3 wherein the sleeve has two seams that allow the sleeve to be split into two semicylinders for removal of metal plated onto the inner surface of the sleeve.

5. The metal recovery apparatus of claim 1 wherein a first discharge of the first fluid circuit is positioned within the annulus so that an angular speed of the fluid in the annulus is greater near the outer surface of the annulus.

6. The metal recovery apparatus of claim 5 wherein the first fluid circuit further comprises a second circulation pump to further boost the speed of fluid within the annulus.

7. The metal recovery apparatus of claim 6 wherein a second discharge of the first fluid circuit is disposed on an opposite side of the annulus from the first discharge, the second discharge being positioned within the annulus so that the flow in the annulus has a highest angular speed near the outer surface of the annulus.

8. The metal recovery apparatus of claim 1 wherein fluid is retained in the cell between batches to prevent metal and chemical residue buildup.

9. The metal recovery apparatus of claim 8 wherein the fluid retained in the cell has a depth of about one inch.

10. A metal recovery apparatus for use in recovery of metal from a metal-laden fluid, the apparatus comprising:

a casing with a substantially cylindrical inner surface;

a first electrode adapted for attachment to a pole of a source of electricity and comprising an annular sleeve insertable into the casing such that an outer surface of the sleeve engages an inner surface of the casing;

a second electrode adapted for attachment to an opposite pole and arranged in the casing so that an outer surface of the second electrode faces an inner surface of the first electrode to form a substantially annular space through which metal-laden fluid can flow, the electrodes and substantially annular space thus forming part of an electrolytic cell;

a fluid supply circuit providing metal-laden fluid to the cell and carrying fluid out of the cell; and a fluid circulation circuit boosting the speed of metal-laden fluid in the cell and forcing the metal-laden fluid to swirl between the walls of the cell in such a way that the fluid travels at a higher angular speed and with more turbulence near the inner surface of the first electrode than near the outer surface of the second electrode, a fluid circulation rate in the fluid circulation circuit being substantially higher than a fluid supply rate in the fluid supply circuit.

11. The metal recovery apparatus of claim 10 in which the fluid circulation circuit comprises a first pump that draws fluid from the cell and returns the fluid to the cell after energizing the fluid, thereby boosting the angular speed of fluid within the annulus substantially without effect on the flow rate through the supply circuit.

12. The metal recovery apparatus of claim 11 wherein the circulation circuit includes a second pump to further boost speed of the fluid within the cell.

13. The metal recovery apparatus of claim 12 wherein discharges from the first and second pumps are diametrically opposed in the annulus between the inner surface of the sleeve and the outer surface of the second electrode.

14. The metal recovery apparatus of claim 10 wherein the flow rate in the circulation circuit is in the range of from about 20 gallons per minute to about 40 gallons per minute.

15. The metal recovery apparatus of claim 10 wherein a ratio of an area of the inner surface of the first electrode to an area of the outer surface of the second electrode is optimized to maximize a current efficiency in the cell.

16. The metal recovery apparatus of claim 15 wherein the ratio falls in the range of from about 1.8:1 to about 2.4:1.

17. The metal recovery apparatus of claim 16 wherein the ratio is about 2:1.

18. The metal recovery apparatus of claim 15 wherein a distance between the inner surface of the outer electrode and the outer surface of the inner electrode is in the range of from about 1.5 to about 2.5 inches.

19. A metal recovery apparatus for the recovery of metals from metal-laden fluids comprising:

an annulus of metal-laden fluid rotating about a longitudinal axis of the annulus and within an electrolytic cell, an outer region of the annulus traveling at a higher angular speed and having more turbulence than an inner region of the annulus;

a fluid circulation circuit adapted to maintain the annulus of fluid in a state of rotation and to maintain the higher angular speed of the fluid in the outer region of the annulus;

a fluid supply circuit adapted to provide flow from a batch tank to the annulus of fluid, a flow rate in the fluid supply circuit being substantially lower than a flow rate in the fluid circulation circuit;

a first electrode of the electrolytic cell disposed coaxially with the annulus of fluid, an inner surface of the first electrode comprising an outer boundary of the annulus of fluid and possessing an electrical charge of one polarity;

a second electrode of the electrolytic cell disposed near an inner boundary of the annulus of fluid such that an outer surface of the second electrode faces an inner surface of the first electrode, the second electrode possessing an electrical charge of an opposite polarity as compared to the electrical charge of the inner surface of the first electrode, an electrical field established by the first and second electrodes forcing metal in the metal-laden fluid to plate onto one of the first and second electrodes; and a casing supporting the annulus of fluid and the first and second electrodes.

20. The metal recovery apparatus of claim 19 wherein the fluid circulation circuit comprises a first discharge disposed within the annulus of fluid so that the discharge induces rotation of the annulus of fluid at a higher angular speed and with more turbulence at the outer region of the annulus than in the inner region of the annulus.

21. The metal recovery apparatus of claim 20 wherein the first discharge is connected to a pump.

22. The metal recovery apparatus of claim 20 wherein the fluid circulation circuit includes a second discharge diametrically opposed from the first discharge within the annulus of fluid, the second discharge also inducing rotation of the annulus of fluid at a higher angular speed and with more turbulence at the outer region of the annulus than in the inner region of the annulus.

23. The metal recovery apparatus of claim 22 wherein the first and second discharges are connected to a pump.

24. The metal recovery apparatus of claim 23 wherein the first and second discharges are connected to respective pumps.

25. The metal recovery apparatus of claim 19 wherein the first electrode is a metal sleeve insertable into the casing onto which metal from the metal-laden fluid plates.

26. The metal recovery apparatus of claim 19 wherein the first electrode includes a seam that allows the sleeve to be opened for removal of metal plated on an inner surface of the sleeve.

27. The metal recovery apparatus of claim 26 wherein the first electrode includes a second seam that allows the first electrode to be split into halves for removal of metal plated on the inner surface of the sleeve.

28. The metal recovery apparatus of claim 19 wherein an outer surface of the first electrode is coated with a non-conductive material to prevent plating of metal thereon.

29. A metal recovery apparatus for recovery of metals from metal-laden fluids, the apparatus comprising:

a casing with a substantially cylindrical inner surface, a bottom, and an inner cylinder disposed coaxially with the inner surface of the casing;

an outer electrode of an electrolytic cell disposed within the casing and adapted for attachment to a source of electricity;

an inner electrode of the electrolytic cell disposed within the outer electrode and adapted for attachment to the source of electricity such that an electrical potential is established between the outer and inner electrodes when both electrodes are attached to the source of electricity and the source of electricity is energized, an electrical current flowing between the outer and inner electrodes when metal-laden fluid is present therebetween; and a current efficiency of the cell being substantially optimized by sizing the outer and inner electrodes such that an area of an inner surface of the outer electrode is in the range of about 1.8 to about 2.4 times an area of an outer surface of the inner electrode.

30. The metal recovery apparatus of claim 29 wherein a distance between the inner surface of the outer electrode and the outer surface of the inner electrode is in the range of from about 1.5 to about 2.5 inches.

31. The metal recovery apparatus of claim 29 wherein metal plates onto the outer electrode and the outer electrode is a cylindrical sleeve that engages an inner surface of the casing but can be removed from the casing for removal of metal plated onto the outer electrode.

32. The metal recovery apparatus of claim 31 wherein the outer electrode includes a seam that allows the outer electrode to be opened for removal of the metal plated thereon.

33. The metal recovery apparatus of claim 32 wherein the outer electrode has two seams that allow the outer electrode to be split into two semicylinders for removal of the metal plated thereon.

34. The metal recovery apparatus of claim 29 wherein the outer electrode is sized so that a top edge of the outer electrode is always above a level of the fluid in the cell.

35. The metal recovery apparatus of claim 29 further comprising:

a fluid supply circuit that carries fluid to and from the electrolytic cell at a through-flow rate; and a fluid circulation circuit that boosts the speed of fluid in the electrolytic cell substantially without altering the through-flow rate, the circulation circuit forcing the fluid to swirl about a longitudinal axis of the cell and a flow rate within the circulation circuit being substantially greater than the through-flow rate.

36. The metal recovery apparatus of claim 35 wherein the fluid circulation circuit comprises a pump that draws fluid from and returns fluid to the cell at a rate that is an order of magnitude greater than the through-flow rate.

37. The metal recovery apparatus of claim 35 wherein the fluid circulation circuit comprises a pump that draws fluid from and returns fluid to the cell at a rate in the range of from about 20 gallons per minute to about 40 gallons per minute.

38. The metal recovery apparatus of claim 35 wherein an angular speed of the fluid is higher near the outer electrode than near the inner electrode.

39. The metal recovery apparatus of claim 35 wherein the fluid is more turbulent near the outer electrode than near the inner electrode.

40. A metal recovery apparatus for recovery of metals from metal-laden fluids, the apparatus comprising:

an annulus through which metal-laden fluid is circulated, the annulus being defined by an outer electrode and an inner electrode, the electrodes and the annulus forming part of an electrolytic cell and being disposed within a casing;

a fluid supply circuit sending fluid from a source of metal-laden fluid to the cell and returning the fluid from the cell to the source of metal-laden fluid;

a fluid circulation circuit energizing fluid within the cell and forcing the fluid to swirl within the annulus such that an angular speed of the fluid is higher near the outer electrode than near the inner electrode, a circulation flow rate of the fluid circulation circuit being substantially higher than a supply flow rate in the fluid supply circuit; and the electrodes being adapted for attachment to an electrical power source such that when electricity is applied to the cell and metal-laden fluid is in the cell, metal in the metal-laden fluid plates onto one of the electrodes.

41. The metal recovery apparatus of claim 40 wherein the fluid circulation circuit also induces greater turbulence in the fluid near the inner surface of the outer electrode.

42. The metal recovery apparatus of claim 40 wherein a flow rate in the fluid supply circuit is substantially lower than a flow rate in the fluid circulation circuit.

43. The metal recovery apparatus of claim 42 wherein the flow rate in the fluid supply circuit is in the range of about 2 gallons per minute to about 4 gallons per minute.

44. The metal recovery apparatus of claim 42 wherein the flow rate in the fluid circulation circuit is in the range of about 20 gallons per minute to about 40 gallons per minute.

45. The metal recovery apparatus of claim 40 wherein a current efficiency of the electrolytic cell is substantially optimized.

46. The metal recovery apparatus of claim 45 wherein an area of an inner surface of the outer electrode is in the range of about 1.8 to about 2.4 times that of an area of an outer surface of the inner electrode.

* * * * *